US010487652B2

(12) United States Patent
Smarandache et al.

(10) Patent No.: US 10,487,652 B2
(45) Date of Patent: Nov. 26, 2019

(54) DOWNHOLE SAMPLING TOOL WITH CHECK VALVE PISTON

(71) Applicant: Schlumberger Technology Corporation, Sugar Land, TX (US)

(72) Inventors: Marius Smarandache, Houston, TX (US); Sebastien Ives, Houston, TX (US); Malcolm Philip Atkinson, Missouri City, TX (US); Douglas Grant, College Station, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 289 days.

(21) Appl. No.: 15/241,853

(22) Filed: Aug. 19, 2016

(65) Prior Publication Data

US 2018/0051560 A1 Feb. 22, 2018

(51) Int. Cl.
*E21B 49/08* (2006.01)
*E21B 34/08* (2006.01)

(52) U.S. Cl.
CPC ..... *E21B 49/081* (2013.01); *E21B 34/08* (2013.01)

(58) Field of Classification Search
CPC ..... E21B 34/08; E21B 49/081
See application file for complete search history.

(56) References Cited

U.S. PATENT DOCUMENTS 6,192,984 B1 * 2/2001 Schultz ..... E21B 49/081 166/264
2005/0115716 A1 6/2005 Ciglenec et al.
2011/0276187 A1 11/2011 Ciglenec et al.
2013/0020077 A1 * 1/2013 Irani ..... E21B 49/10 166/264
2016/0168989 A1 6/2016 Gilbert et al.

FOREIGN PATENT DOCUMENTS

EP 3034775 A1 6/2016

OTHER PUBLICATIONS

International Search Report and Written Opinion issued in the related PCT application PCT/US2017/047068, dated Nov. 6, 2017 (19 pages).
International Preliminary Report on Patentability issued in the related PCT application PCT/US2017/047068, dated Feb. 28, 2019 (16 pages).

* cited by examiner

*Primary Examiner* — Caroline N Butcher
(74) *Attorney, Agent, or Firm* — Cameron R. Sneddon

(57) ABSTRACT

A sampling tool includes a tubular member and a sampling piston positioned within the tubular member. The sampling piston has a bore formed axially-therethrough. A secondary piston is positioned within the bore of the sampling piston. A check valve assembly is positioned at least partially within the tubular member. The secondary piston and the check valve assembly move together with respect to the tubular member.

21 Claims, 11 Drawing Sheets

DOWNHOLE SAMPLING TOOL WITH CHECK VALVE PISTON

BACKGROUND

In many types of well applications, fluid samples are captured downhole and tested to help evaluate well fluid and/or geologic formation parameters. To obtain the desired fluid sample, a sampling tool is deployed downhole into a wellbore, and the fluid sample is drawn through a port and into a sampling chamber in the tool. A variety of pistons and/or other devices may be used to draw the fluid sample into the sample chamber. Once the fluid sample is in the chamber, the chamber is closed prior to pulling the sampling tool back to the surface, as accurate compositional and PVT analyses of the fluid sample may depend upon the fluid sample remaining at downhole conditions. Problems sometimes occur, however, due to inadvertent, premature closing and/or opening of the sample chamber.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A sampling tool is disclosed. The sampling tool includes a tubular member and a sampling piston positioned within the tubular member. The sampling piston has a bore formed axially-therethrough. A secondary piston is positioned within the bore of the sampling piston. A check valve assembly is positioned at least partially within the tubular member. The secondary piston and the check valve assembly move together with respect to the tubular member.

In another embodiment, the sampling tool includes a tubular member and a sampling piston positioned within the tubular member. The sampling piston moves axially within the tubular member, and the sampling piston has a bore formed axially-therethrough. A secondary piston is positioned within the bore of the sampling piston. The secondary piston moves axially within the bore of the sampling piston. A check valve assembly is positioned at least partially within the tubular member. At least a portion of the check valve assembly may be inserted into the bore of the sampling piston, and the secondary piston and the check valve assembly move together with respect to the tubular member.

A method for capturing a fluid sample in a wellbore includes running a sampling tool into the wellbore. The sampling tool includes a tubular member and a sampling piston positioned within the tubular member. The sampling piston has a bore formed axially-therethrough. A secondary piston is positioned within the bore of the sampling piston. A check valve assembly is positioned at least partially within the tubular member. The method also includes increasing a pressure of a fluid in the tubular member on a first side of the sampling piston and the check valve assembly, causing the secondary piston and the check valve assembly to move together with respect to the tubular member.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
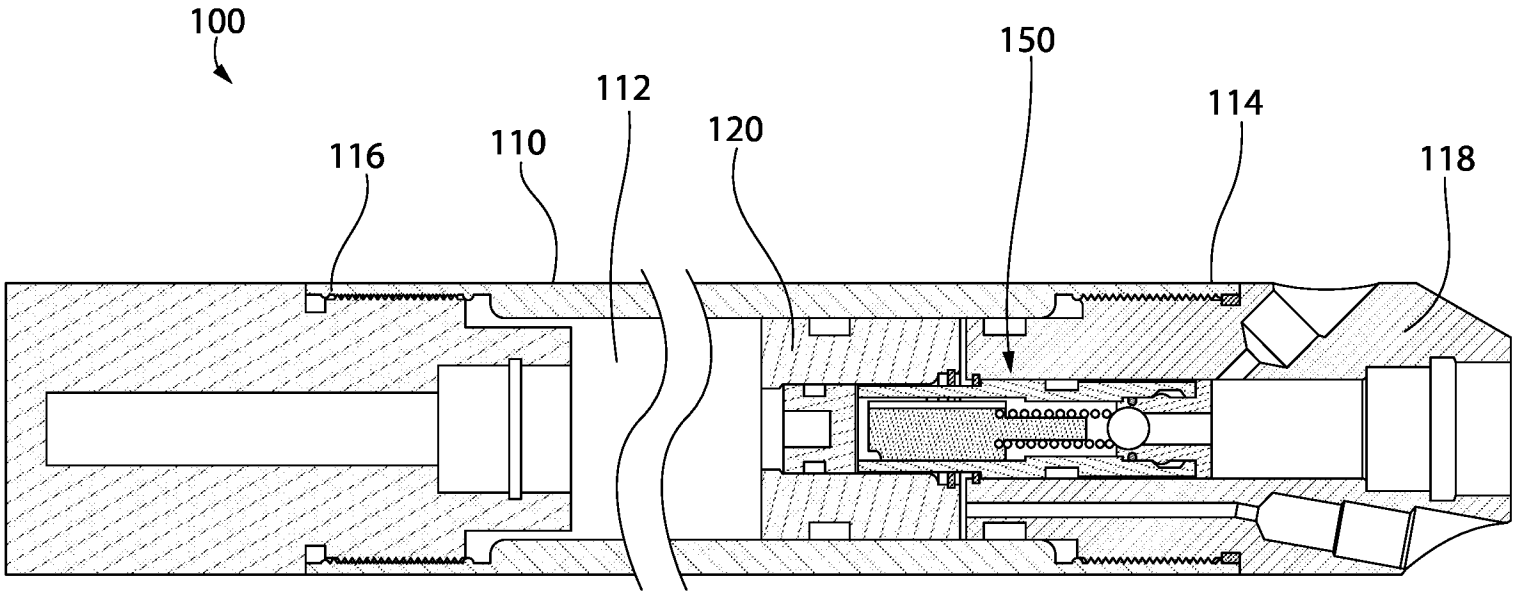
FIG. 1 illustrates a cross-sectional side view of a sampling tool, according to an embodiment.

FIG. 1 illustrates a cross-sectional side view of a sampling tool 100, according to an embodiment. The sampling tool 100 may include a tubular member 110 having a bore 112 formed axially-therethrough. The tubular member 110 may include a first (e.g., lower) end 114 and a second (e.g., upper) end 116. A fixing head 118 may be coupled to and/or positioned at least partially within the first end 114 of the tubular member 110.

A sampling piston 120 may be positioned at least partially within the tubular member 110. A check valve assembly 150 may be positioned at least partially within the tubular member 110 and/or at least partially within the fixing head 118. As described in greater detail below, the sampling piston 120 and/or the check valve assembly 150 may move axially within the tubular member 110. As shown, when the sampling piston 120 is positioned proximate to the first end 114 of the tubular member 110, the check valve assembly 150 may be inserted at least partially into an axial bore formed through the sampling piston 120.

Figure 2:
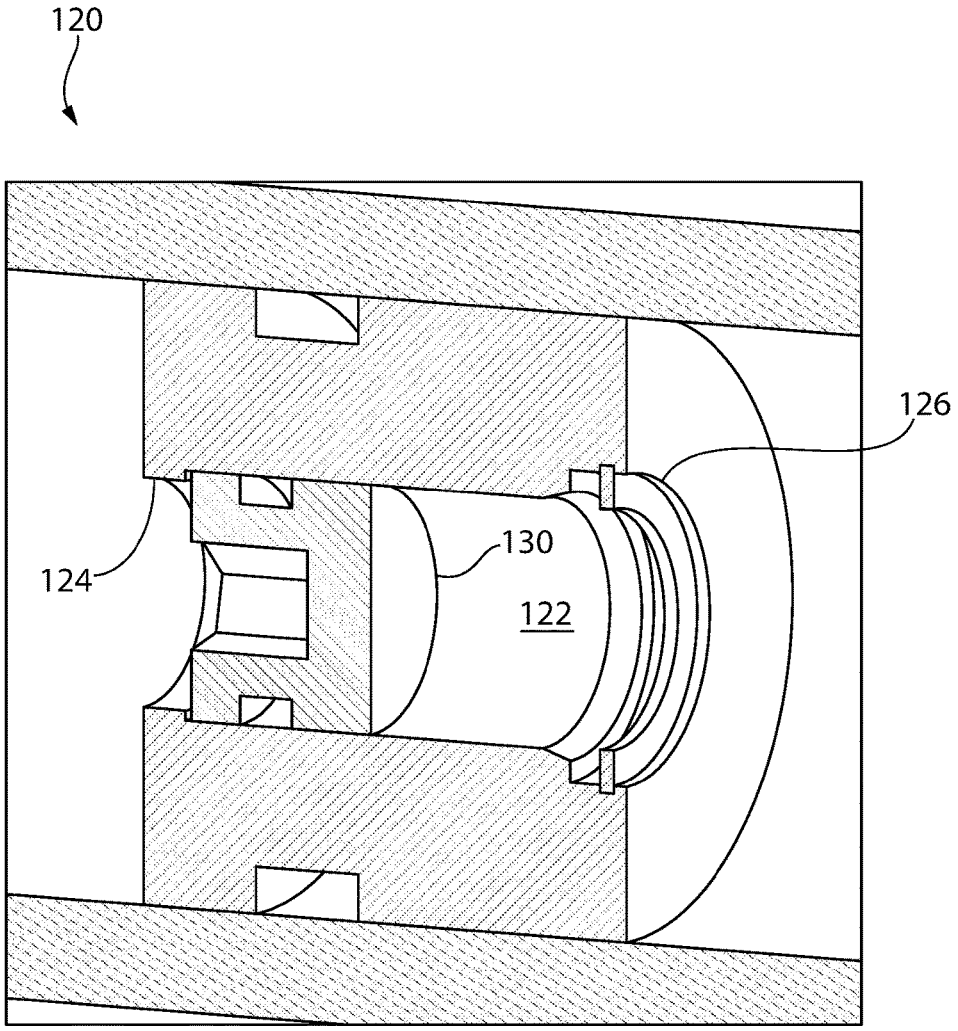
FIG. 2 illustrates a cross-sectional perspective view of a sampling piston in the sampling tool, according to an embodiment.

FIG. 2 illustrates a cross-sectional perspective view of the sampling piston 120, according to an embodiment. The sampling piston 120 may have a bore 122 formed axially-therethrough. A secondary piston 130 may be positioned within the bore 122 of the sampling piston 120. The secondary piston 130 may move axially within the bore 122 of the sampling piston 120. The secondary piston 130 may be prevented from exiting the bore 122 of the sampling piston 120 by axially-offset barriers 124, 126. As shown, the first barrier 124 is a shoulder that extends radially-inward from the inner surface of the sampling piston 120, and the second barrier 126 is a retainer ring that is inserted into an annular groove formed in the inner surface of the sampling piston 120.

Figure 3:
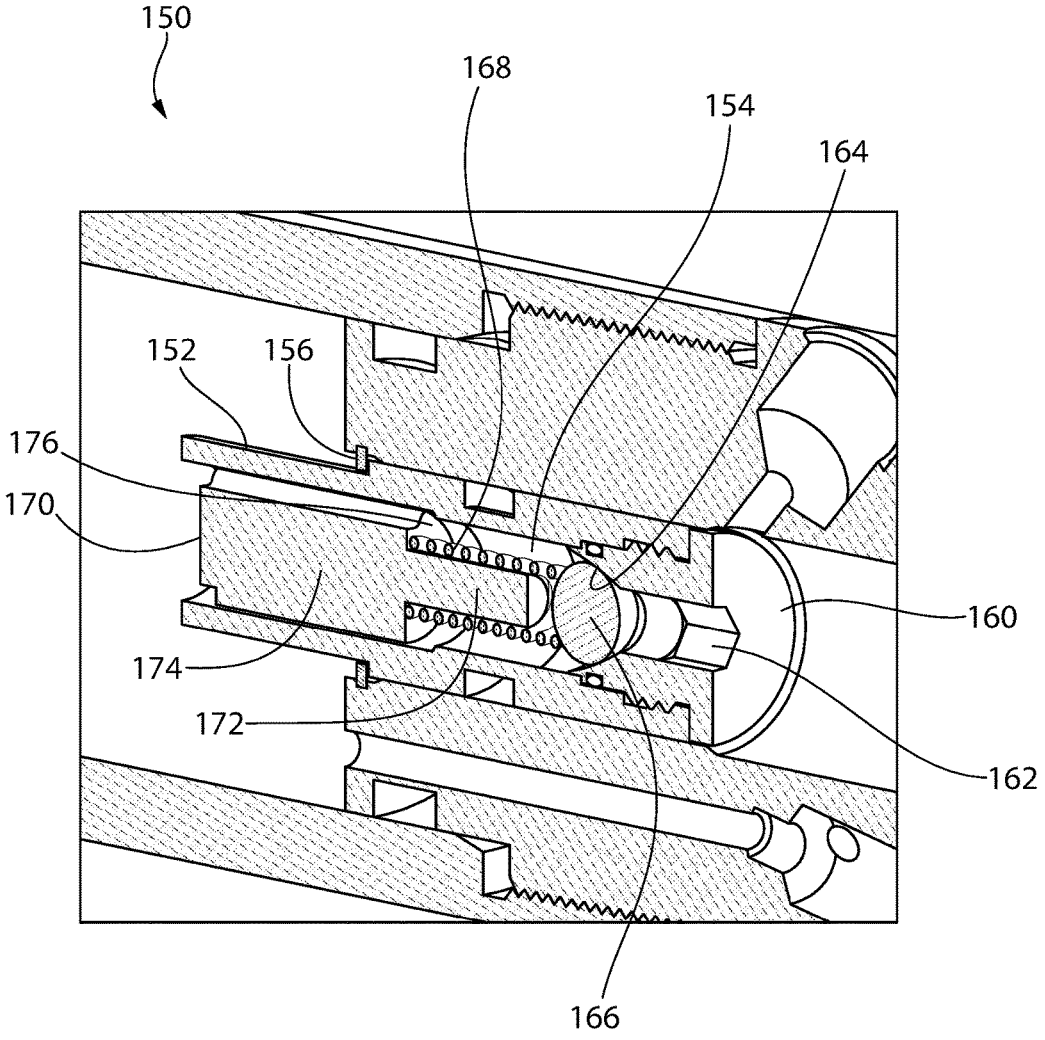
FIG. 3 illustrates a cross-sectional perspective view of a check valve assembly in the sampling tool, according to an embodiment.

FIG. 3 illustrates a cross-sectional perspective view of the check valve assembly 150, according to an embodiment. The check valve assembly 150 may include a housing 152 having a bore 154 formed axially-therethrough. The housing 152 may be prevented from moving in at least one axial direction (e.g., to the left in FIG. 3) by a barrier 156. As shown, the barrier 156 may be a retainer ring. In another embodiment, the barrier 156 may be a shoulder that extends radially-inward from the fixing head 118.

An end cap 160 may be coupled to and/or positioned at least partially within a first (e.g., lower) end of the housing 152. The end cap 160 may have a bore 162 formed axially-therethrough. The end cap 160 may define a seat 164.

An impediment (e.g., a ball) 166 may be positioned within the bore 154 of the housing 152. The impediment 166 may be configured to rest in the seat 164 of the end cap 160. When the impediment 166 rests within the seat 164 of the end cap 160, the impediment 166 may prevent fluid (e.g., water or a downhole fluid sample) from flowing axially-through the end cap 160 and, thus, through the housing 152. As described in greater detail below, when the impediment 166 is offset from the seat 164 of the end cap 160, fluid may flow through the end cap 160 and, thus, through the housing 152.

A biasing member (e.g., a spring) 168 may also be positioned in bore 162 of the housing 152. The biasing member 168 may exert an axial force on the impediment 166 toward the seat 164 of the end cap 160.

A check valve piston 170 may also be positioned in bore 154 of the housing 152. The check valve piston 170 may include a first (e.g., lower) portion 172 having a first cross-sectional length (e.g., diameter) and a second (e.g., upper) portion 174 having a second cross-sectional length (e.g., diameter), where the second cross-sectional length is greater than the first cross-sectional length. As shown, the first portion 172 may be positioned at least partially within the biasing member 168. The check valve piston 170 may define a shoulder 176 between the first and second portions 172, 174. The biasing member 168 may be positioned axially-between the impediment 166 and the shoulder 176 of the check valve piston 170.

Figure 4:
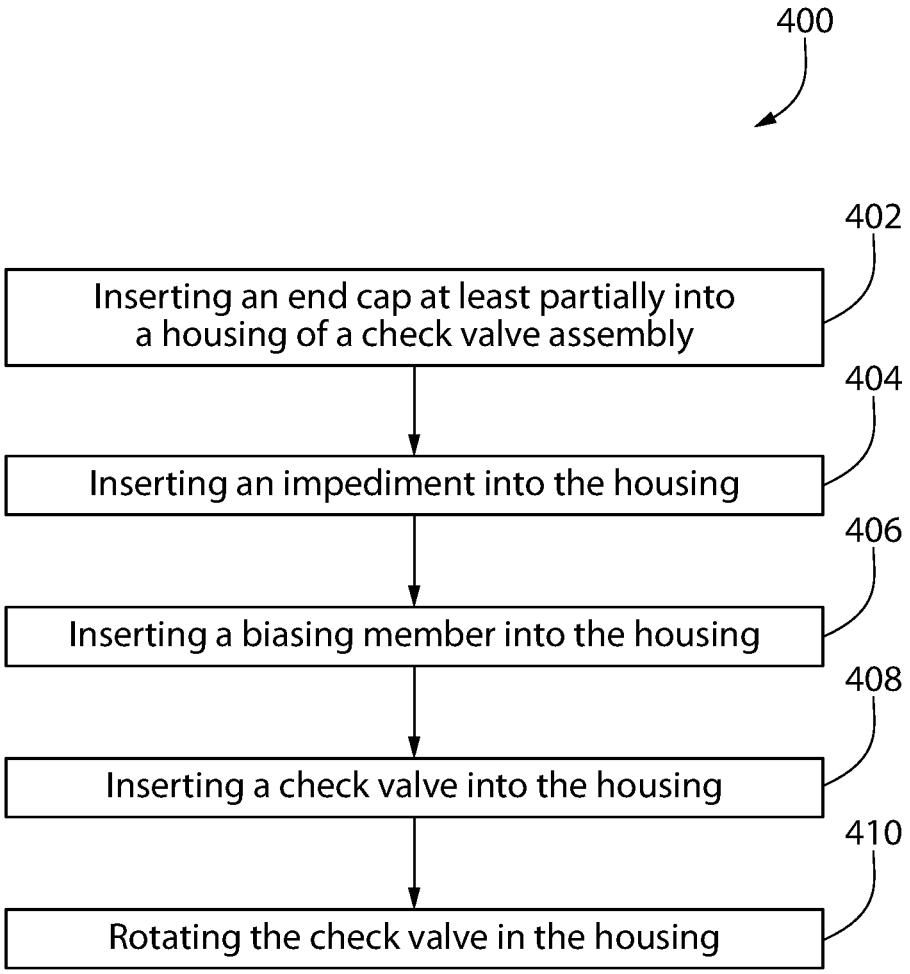
FIG. 4 illustrates a flowchart of a method for assembling the check valve assembly, according to an embodiment.
Figure 5:
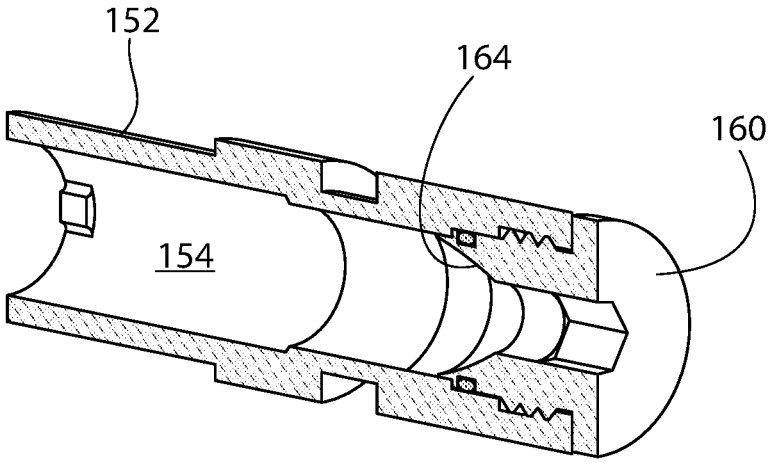
FIG. 5 illustrates a cross-sectional perspective view of an end cap positioned at least partially within a housing of the check valve assembly, according to an embodiment.
Figure 6:
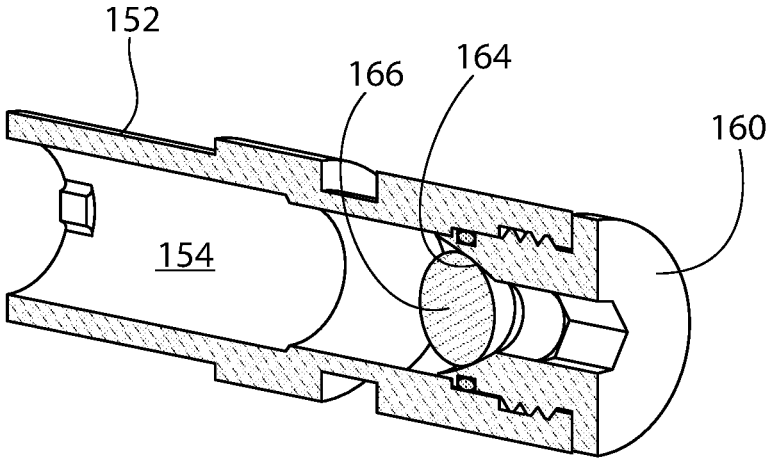
FIG. 6 illustrates a cross-sectional perspective view of an impediment (e.g., a ball) positioned within the housing, according to an embodiment.
Figure 7:
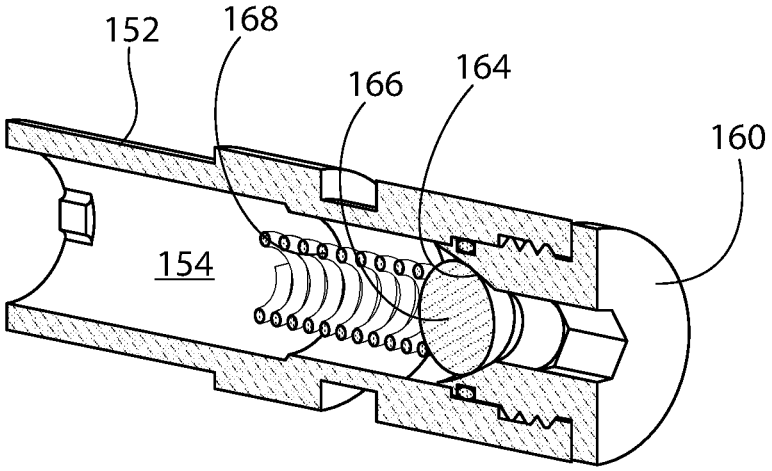
FIG. 7 illustrates a cross-sectional perspective view of a biasing member (e.g., a spring) positioned within the housing, according to an embodiment.
Figure 8:
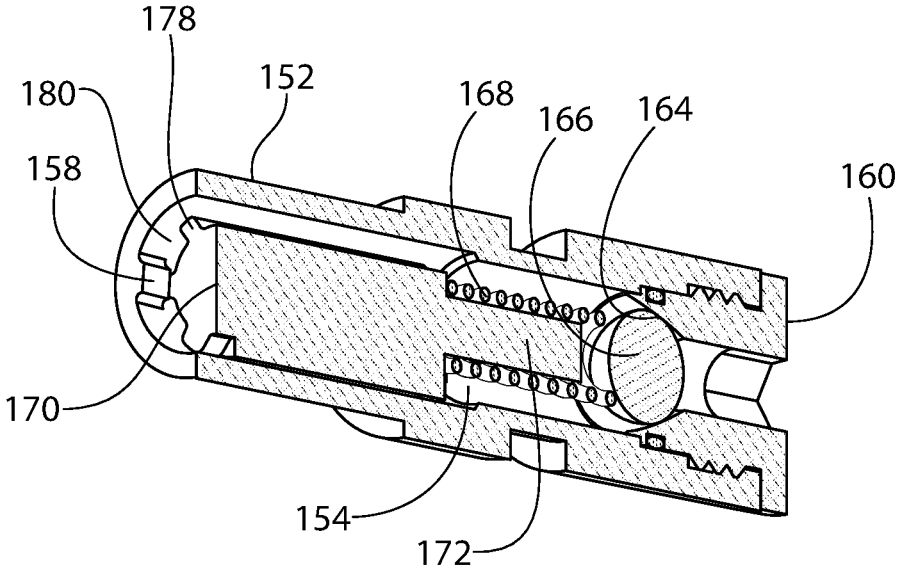
FIGS. 8 and 9 illustrate cross-sectional perspective views of a check valve piston positioned within the housing, according to an embodiment.
Figure 9:
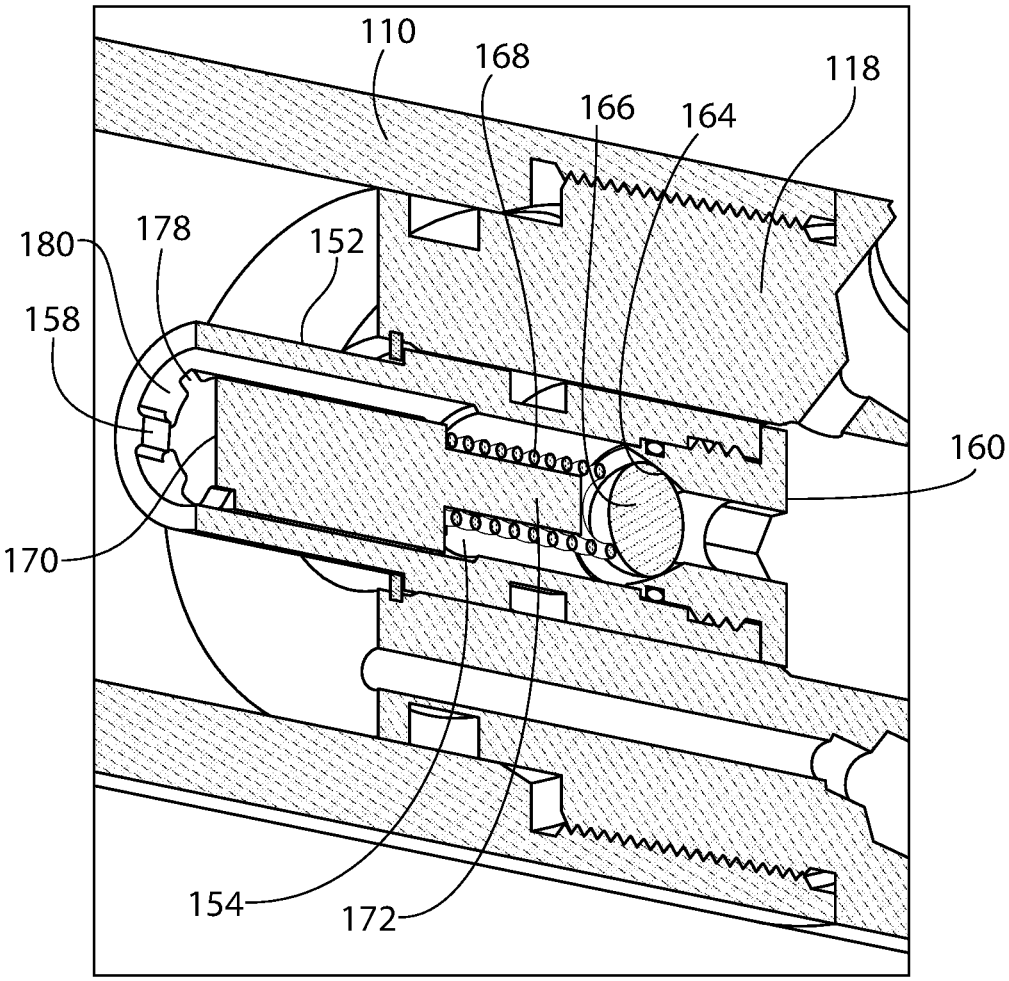

FIG. 4 illustrates a flowchart of a method 400 for assembling the check valve assembly 150, according to an embodiment. FIGS. 5-9 illustrate various stages of assembling of the check valve assembly 150, and may be viewed together with FIG. 4. The method 400 may include inserting the end cap 160 at least partially into the bore 154 of the housing 152, as at 402. This is shown in FIG. 5. The method 400 may also include inserting the impediment 166 into the bore 154 of the housing 152, as at 404. This is shown in FIG. 6. The method 400 may also include inserting the biasing member 168 into the bore 154 of the housing 152 such that the impediment 166 is positioned between the biasing member 168 and the seat 164 of the end cap 160, as at 406. This is shown in FIG. 7. The method 400 may also include inserting the check valve piston 170 into the bore 154 of the housing 152, as at 408. This is shown in FIGS. 8 and 9. Inserting the check valve piston 170 into the bore 154 of the housing 152 may include inserting the first portion 172 of the check valve piston 170 into the biasing member 168.

The method 400 may also include rotating the check valve piston 170 within the housing 152 to secure the check valve piston 170 within the housing 152, as at 410. More particularly, referring to FIG. 9, the second (e.g., upper) end of the housing 152 may include one or more protrusions 158 that extend radially-inward therefrom, and the check valve piston 170 may include one or more protrusions 178 that extend radially-outward therefrom. The protrusions 178 on the check valve piston 170 may be rotationally-offset from the protrusions 158 on the housing 152 when the check valve piston 170 is inserted into the bore 154 of the housing 152. Once inserted, the check valve piston 170 may be rotated such that the protrusions 178 on the check valve piston 170 are rotationally-aligned with the protrusions 158 of the housing 152. This may cause the protrusions 158, 178 to at least partially overlap, which prevents the check valve piston 170 from being ejected from the bore 154 of the housing 152 due to the axial force exerted thereon by the biasing member 168.

An axial groove 180 is defined between each two circumferentially-adjacent protrusions 178 on the check valve piston 170. The grooves 180 may serve as axial flow channels formed radially-between the housing 152 and the check valve piston 170. Thus, the grooves 180 may provide a path of fluid communication axially-past the check valve piston 170 in the housing 152.

Figure 10:
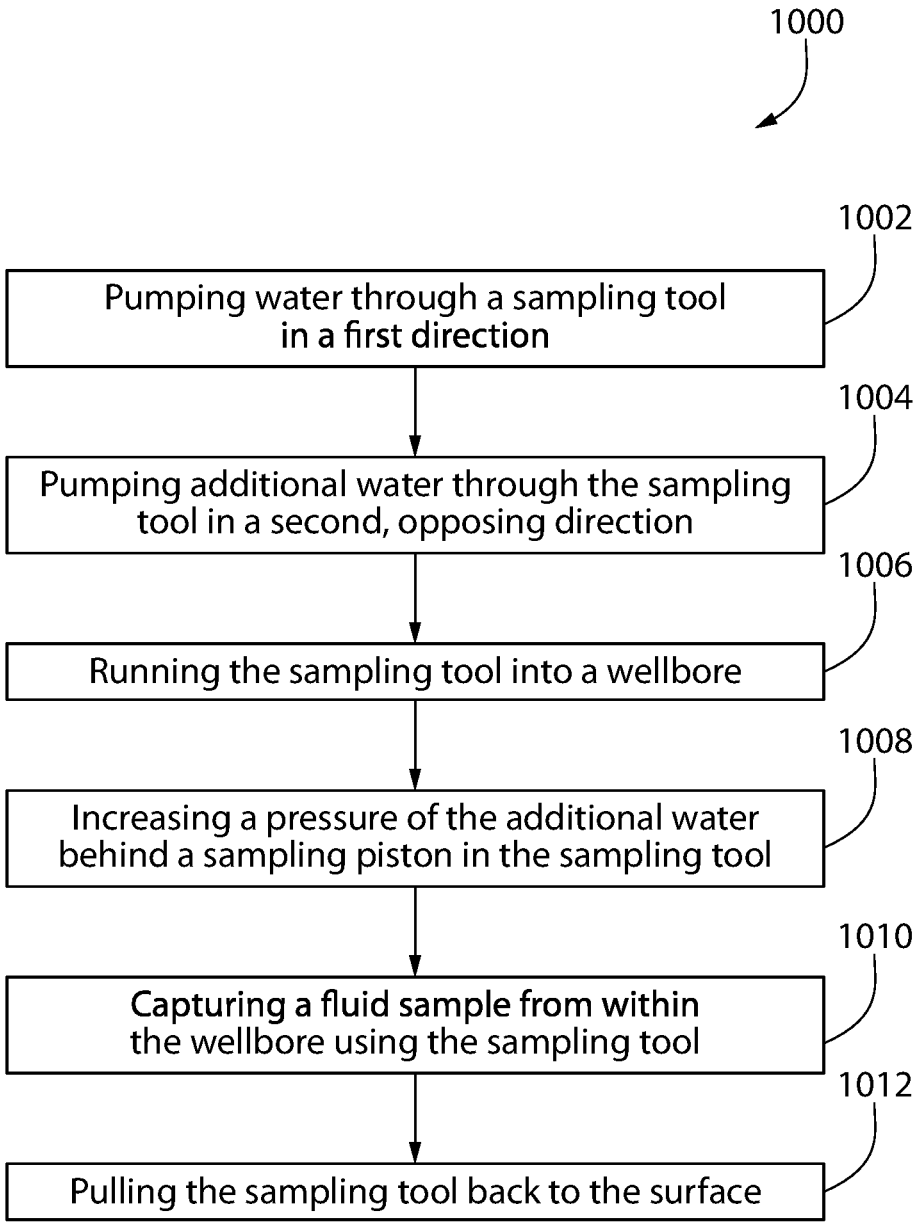
FIG. 10 illustrates a flowchart of a method for capturing a fluid sample using the sampling tool, according to an embodiment.
Figure 11:
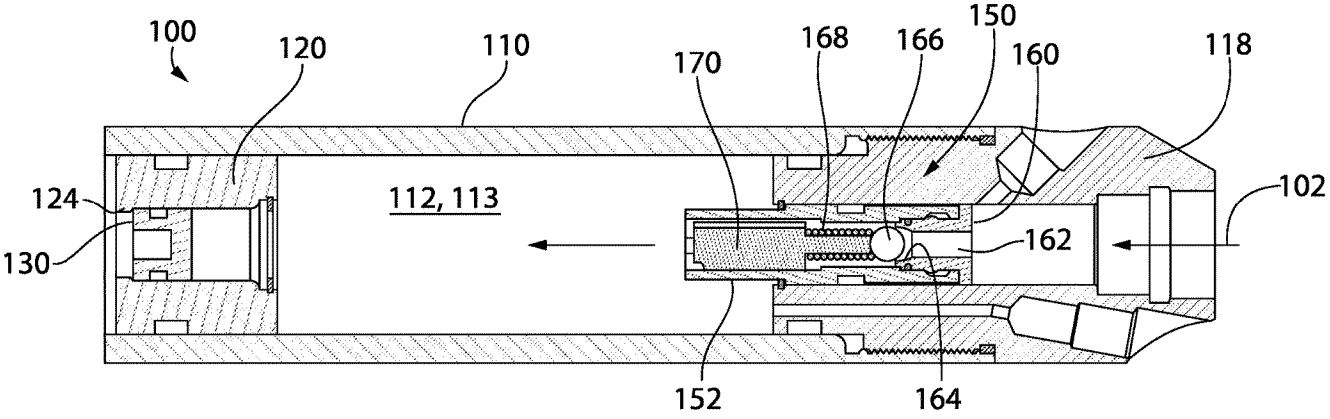
FIG. 11 illustrates a cross-sectional side view of the sampling tool with water being pumped therethrough in a first direction to move the sampling piston in the first direction, according to an embodiment.

FIG. 10 illustrates a flowchart of a method 1000 for capturing a fluid sample using the sampling tool 100, according to an embodiment. FIGS. 11-15 illustrate various stages of capturing the fluid sample, and may be viewed together with FIG. 10. The method 1000 may include preparing the sampling tool 100 at the surface (i.e., before running the sampling tool 100 into a wellbore). More particularly, at the surface, the method 1000 may include pumping water (e.g., distilled water) through the sampling tool 100 in a first direction 102, as at 1002. This is shown in FIG. 11.

A pump may cause the water to flow through the fixing head 118 and into the bore 162 in the end cap 160 of the check valve assembly 150, where the water may exert a hydraulic force on the impediment 166 in the first direction 102. When the hydraulic force exerted on the impediment 166 by the water is greater than the opposing force exerted on the impediment 166 by the biasing member 168, the impediment 166 may move away from the seat 164 of the end cap 160 and compress the biasing member 168. Once the impediment 166 is offset from the seat 164 of the end cap 160, the water may flow around the impediment 166 and through the grooves 180 of the check valve piston 170. The water may then flow out of the grooves 180 (see FIGS. 8 and 9) of the check valve piston 170 and into a portion of the bore 112 of the tubular member 110 between the sampling piston 120 and the fixing head 118 referred to as the "sampling chamber" 113.

The water in the sampling chamber 113 may exert a hydraulic force on the sampling piston 120, causing the sampling piston 120 to move axially-toward the second end 116 of the tubular member 110 (i.e., away from the check valve assembly 150). The volume of water in the sampling chamber 113 may increase proportionally to the axial distance that the sampling piston 120 moves away from the check valve assembly 150. In addition, the water may exert a hydraulic force on the secondary piston 130 inside the sampling piston 120, causing the secondary piston 130 to move toward the first barrier (e.g., the shoulder) 124 within the sampling piston 120.

Figure 12:
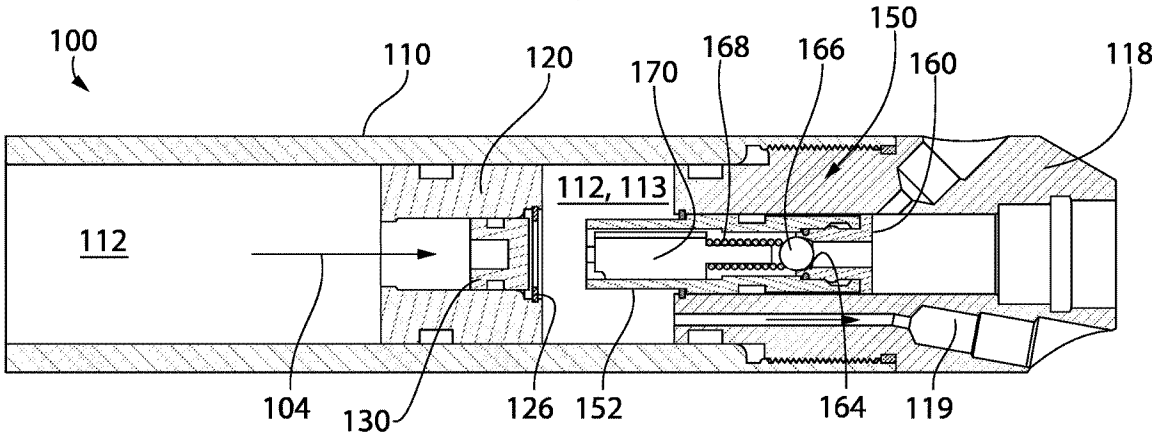
FIG. 12 illustrates a cross-sectional side view of the sampling tool with additional water being pumped therethrough in a second direction to move the sampling piston in the second direction, according to an embodiment.

Also while at the surface, the method 1000 may include pumping additional water (or another fluid, e.g., oil) through the sampling tool 100 in a second, opposing direction 104, as at 1004. This is shown in FIG. 12. The pump may cause the additional water to flow into the bore 112 of the tubular member 110 through the second end thereof 116 and toward the sampling piston 120. The additional water may exert a hydraulic force on the sampling piston 120 that causes the sampling piston 120 to move in the second direction 104. As the sampling piston 120 moves in the second direction 104, the impediment 166 may be engaged with the seat 164 of the end cap 160, thereby preventing the water in the sampling chamber 113 from flowing through the bore 162 of the end cap 160 in the second direction 104. Instead, the water may exit the sampling tool 100 through a port 119 formed through the fixing head 118.

Figure 13:
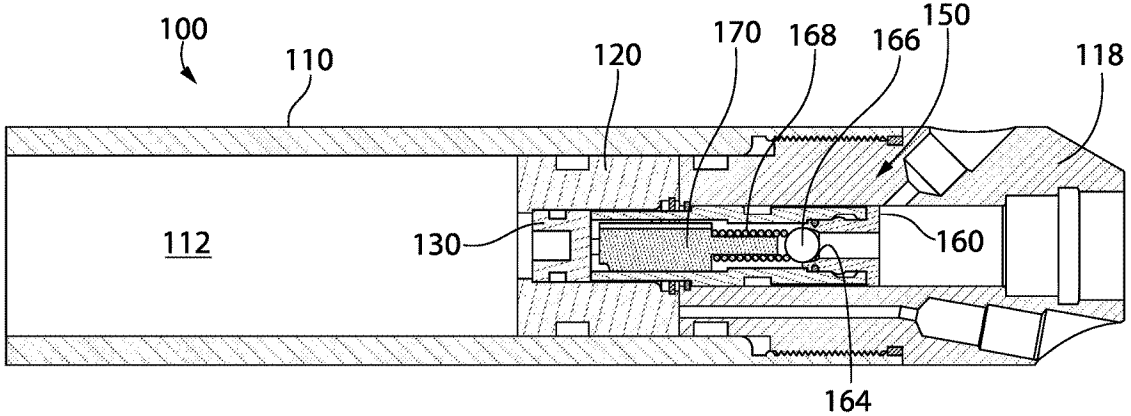
FIG. 13 illustrates a cross-sectional side view of the sampling tool when the sampling tool is run into a wellbore, according to an embodiment.

As the sampling piston 120 approaches the check valve assembly 150, at least a portion of the check valve assembly 150 (e.g., the housing 152) may become inserted within the bore 122 of the sampling piston 120, pushing the secondary piston 130 in the first direction 102 with respect to the sampling piston 120. The sampling piston 120 may move in the second direction 104 until the sampling piston 120 contacts/abuts the fixing head 118, placing the sampling tool 100 in a "run-in position," as shown in FIG. 13.

The method 1000 may also include running the sampling tool 100 into a wellbore when the sampling tool 100 is in the run-in position, as at 1006. As the sampling tool 100 is being run into the wellbore, or after the sampling tool 100 reaches the desired depth in the wellbore, the method 1000 may include increasing a pressure of a fluid (e.g., the additional water) behind the sampling piston 120, as at 1008. As used herein, "behind the sampling piston 120" refers to between the second end 116 of the tubular member 110 and the sampling piston 120. The pressure may be increased behind the sampling piston 120 by a pump at the surface. Instead of, or in addition to the pump, the pressure may be increased behind the sampling piston 120 by lowering the sampling tool 100 farther in the wellbore (i.e., increasing the depth).

Figure 14:
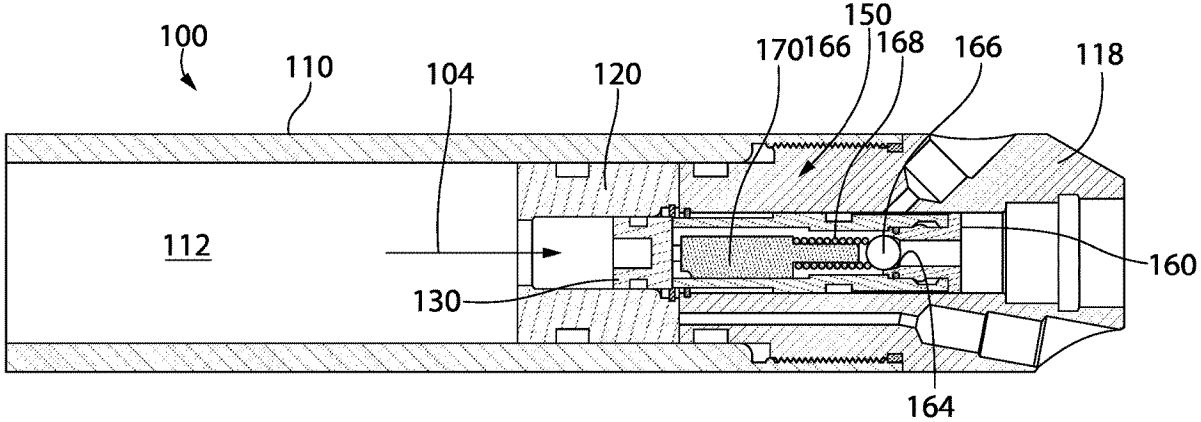
FIG. 14 illustrates a cross-sectional side view of the sampling tool with pressure being equalized across the check valve assembly, according to an embodiment.

In response to the increased pressure, the secondary piston 130 and the check valve assembly 150 (e.g., the housing 152, the end cap 160, the impediment 166, the biasing member 168, the check valve piston 170, or a combination thereof) may move together in the second direction 104 (i.e., away from the sampling piston 120). More particularly, the secondary piston 130 and the check valve assembly 150 may move together (e.g., simultaneously and in the same direction) from a first position with respect to the sampling piston 120 (FIG. 13) to a second position with respect to the sampling piston 120 (FIG. 14). The fluid in front of the check valve assembly 150 may be compressed in response to the secondary piston 130 and the check valve assembly 150 moving together in the second direction 104, thereby substantially equalizing the pressure across the check valve assembly 150.

Figure 15:
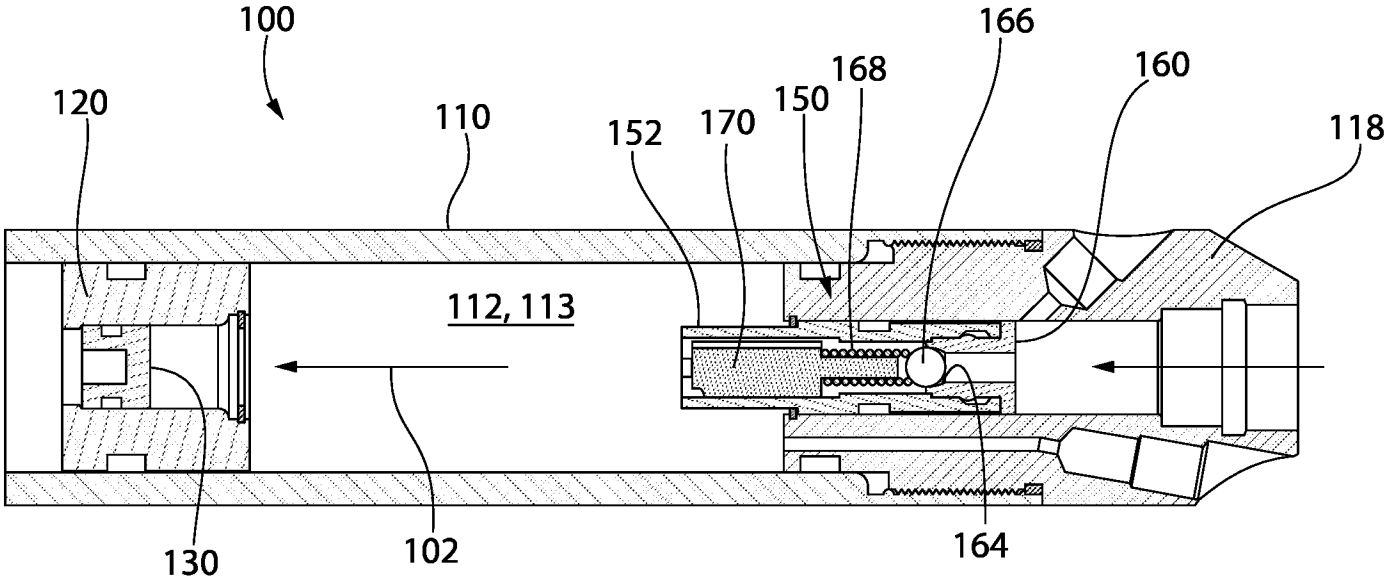
FIG. 15 illustrates a cross-sectional side view of the sampling tool capturing a fluid sample in the wellbore, according to an embodiment.

The method 1000 may also include capturing a fluid sample from within the wellbore using the sampling tool 100, as at 1010. This is shown in FIG. 15. After the pressure across the check valve assembly 150 has been substantially equalized, a valve in a carrier of the sampling tool 100 may be opened allowing the fluid sample to flow in therethrough. The fluid sample may be or include hydrocarbons, gas, water, or a combination thereof. The fluid sample may flow through the fixing head 118 and into the bore 162 in the end cap 160 of the check valve assembly 150, where the fluid sample may exert a hydraulic force on the impediment 166 in the first direction 102. A pumping module on the carrier may increase the pressure of the fluid sample, in response to a command from the surface engineer, causing the hydraulic force on the impediment 166 in the first direction. When the hydraulic force exerted on the impediment 166 by the fluid sample is greater than the opposing force exerted on the impediment 166 by the biasing member 168, the impediment 166 may move away from the seat 164 of the end cap 160 and compress the biasing member 168. Once the impediment 166 is offset from the seat 164 of the end cap 160, the fluid sample may flow around the impediment 166 and through the grooves 180 of the check valve piston 170. The fluid sample may then flow out of the grooves 180 of the check valve piston 170 and the sampling chamber 113.

The fluid sample in the sampling chamber 113 may exert a hydraulic force on the sampling piston 120, causing the sampling piston 120 to move axially-toward the second end 116 of the tubular member 110 (i.e., away from the check valve assembly 150). The volume of the sample fluid in the sampling chamber 113 may increase proportionally to the axial distance that the sampling piston 120 moves away from the check valve assembly 150.

The sampling tool 100 may have minimal "dead volume" in which water may be disposed when the sampling tool 100 is in the run-in position (FIG. 13). The dead volume may include the empty space in the housing 152 of the check valve assembly 150 (e.g., the grooves 180). As a result of the minimal dead volume, when the fluid sample is captured (FIG. 15), the fluid sample in the sampling chamber 113 may be contaminated/diluted by a minimal amount of water. For example, a ratio of the fluid sample to water in the sampling chamber 113 may be greater than about 10:1, greater than about 25:1, greater than about 50:1, greater than about 75:1, or greater than about 100:1. In at least one embodiment, the contamination achieved by the sampling tool 100 may be less than about 0.1%.

Once the sampling chamber 113 is full (i.e., the sampling piston 120 is prevented from moving further in the first direction 102), the biasing member 168 may push the impediment 166 back into the seat 164 of the end cap 160, thereby sealing the sample fluid within the sampling chamber. The method 1000 may then include pulling the sampling tool 100 back to the surface, as at 1012.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A sampling tool, comprising:

a tubular member;

a sampling piston positioned within the tubular member, wherein the sampling piston has a bore formed axially-therethrough;

a secondary piston positioned within the bore of the sampling piston; and a check valve assembly, wherein the secondary piston and the check valve assembly are configured to move together, simultaneously and in the same direction, with respect to the tubular member.

2. The sampling tool of claim 1, wherein the sampling piston is configured to move axially within the tubular member, and wherein the secondary piston is configured to move axially within the bore of the sampling piston.

3. The sampling tool of claim 2, wherein the secondary piston is prevented from exiting the bore of the sampling piston by first and second barriers that are axially-offset from one another.

4. The sampling tool of claim 1, wherein at least a portion of the check valve assembly is configured to be inserted into the bore of the sampling piston.

5. The sampling tool of claim 1, wherein the check valve assembly comprises:

a housing;

a seat positioned within the housing;

an impediment positioned within the housing and configured to be received within the seat; and a biasing member positioned within the housing that exerts an axial force on the impediment toward the seat.

6. The sampling tool of claim 5, wherein the check valve assembly further comprises a check valve piston positioned within the housing, wherein the biasing member is positioned at least partially between the check valve piston and the impediment.

7. The sampling tool of claim 6, wherein an outer surface of the check valve piston comprises an axial groove that provides an axial flow path between the check valve piston and the housing.

8. The sampling tool of claim 7, wherein the outer surface of the check valve piston also comprises a protrusion that is circumferentially-offset from the axial groove, and wherein an inner surface of the housing comprises a protrusion.

9. The sampling tool of claim 8, wherein the check valve piston is configured to be inserted into the housing when the axial groove of the check valve piston is rotationally-aligned with the protrusion of the housing, and wherein the check valve piston is secured within the housing when the protrusion of the check valve piston is rotationally-aligned with the protrusion of the housing.

10. The sampling tool of claim 1, wherein the sampling tool is configured to capture a fluid sample in a wellbore, and wherein a ratio of the fluid sample to water in the sampling tool is greater than about 50:1.

11. A system, comprising:

a sampling piston configured to move axially within a tubular member, wherein the sampling piston has a bore formed axially-therethrough;

a secondary piston positioned within the bore of the sampling piston, wherein the secondary piston is configured to move axially within the bore of the sampling piston; and axially-offset barriers within the bore of the sampling piston configured to prevent the secondary piston from exiting the sampling piston, wherein at least one of the axially-offset barriers is removable from the sampling piston.

12. The system of claim 11 further comprising a check valve assembly, wherein at least a portion of the check valve assembly is configured to be inserted into the bore of the sampling piston, and wherein the secondary piston and the check valve assembly are configured to move together with respect to the tubular member.

13. The system of claim 12, further comprising a fixing head positioned at least partially within the tubular member, wherein the check valve assembly is positioned at least partially within the fixing head.

14. The system of claim 13, wherein the check valve assembly is configured to move axially within the fixing head to substantially equalize a pressure across the check valve assembly.

15. The sampling tool of claim 14, wherein the fixing head defines a port, and wherein water is configured to flow out of the sampling tool through the port when the sampling piston moves toward the check valve assembly.

16. The sampling tool of claim 12, wherein the check valve assembly comprises:

a housing;

a seat positioned within the housing;

an impediment positioned within the housing and configured to be received within the seat; and a biasing member positioned within the housing that exerts an axial force on the impediment toward the seat.

17. A method for capturing a fluid sample in a wellbore, comprising:

running a sampling tool into the wellbore, wherein the sampling tool comprises:

a tubular member;

a sampling piston positioned within the tubular member, wherein the sampling piston has a bore formed axially-therethrough;

a secondary piston positioned within the bore of the sampling piston; and a check valve assembly; and increasing a pressure of a fluid in the tubular member on a first side of the sampling piston and the check valve assembly, causing the secondary piston and the check valve assembly to move together, simultaneously and in the same direction, with respect to the tubular member.

18. The method of claim 17, further comprising capturing the fluid sample within the wellbore using the sampling tool after the secondary piston and the check valve assembly move together.

19. The method of claim 18, wherein capturing the fluid sample comprises opening a valve on a second side of the sampling piston and the check valve assembly.

20. The method of claim 17, further comprising:

pumping water into the sampling tool in a first direction; and pumping additional water into the sampling tool in a second, opposing direction after the water is pumped into the sampling tool in the first direction and before the sampling tool is run into the wellbore.

21. The method of claim 20, wherein at least a portion of the check valve assembly is inserted into the bore of the sampling piston in response to pumping the additional water into the sampling tool in the second, opposing direction.

* * * * *